US007576646B2

(12) United States Patent
Hayden et al.

(10) Patent No.: US 7,576,646 B2
(45) Date of Patent: Aug. 18, 2009

(54) METHOD AND APPARATUS FOR ADDING WIRELESS DEVICES TO A SECURITY SYSTEM

(75) Inventors: Craig A. Hayden, Rochester, NY (US); Dennis M. Caler, Marion, NY (US); Patrick A. Parker, Rochester, NY (US); James E. Berube, Farmington, NY (US); John B. Crosier, Rochester, NY (US); Alan B. Hayter, Victor, NY (US)

(73) Assignee: Robert Bosch GmbH, Stuttgart (DE)

( * ) Notice: Subject to any disclaimer, the term of this patent is extended or adjusted under 35 U.S.C. 154(b) by 465 days.

(21) Appl. No.: 11/231,059

(22) Filed: Sep. 20, 2005

(65) Prior Publication Data

US 2007/0063836 A1 Mar. 22, 2007

(51) Int. Cl.
*G08B 21/00* (2006.01)

(52) U.S. Cl. ..... 340/540; 340/10.34; 379/37

(58) Field of Classification Search ..... 340/540, 340/506, 10.1, 10.34, 10.41, 572.1, 539.22, 340/531, 539.16, 539.19; 379/37, 45
See application file for complete search history.

(56) References Cited

U.S. PATENT DOCUMENTS

| | | | | |
|---|---|---|---|---|
| 3,781,859 | A | 12/1973 | Hermans | |
| 4,855,713 | A | 8/1989 | Brunius | |
| 5,454,037 | A | 9/1995 | Pacella | |
| 5,499,012 | A | 3/1996 | Tracy et al. | |
| 5,898,368 | A | 4/1999 | Handley et al. | |
| 5,907,279 | A | 5/1999 | Bruins et al. | |
| 6,104,783 | A * | 8/2000 | DeFino | 379/45 |
| 6,166,650 | A * | 12/2000 | Bruwer | 340/426.28 |
| 6,208,247 | B1 * | 3/2001 | Agre et al. | 340/539.19 |
| 6,326,880 | B1 | 12/2001 | Tice | |
| 6,593,850 | B1 | 7/2003 | Addy | |
| 6,624,750 | B1 | 9/2003 | Marman et al. | |
| 6,737,967 | B2 | 5/2004 | Farley | |
| 6,980,080 | B2 * | 12/2005 | Christensen et al. | 340/825.22 |
| 7,019,639 | B2 * | 3/2006 | Stilp | 340/539.14 |
| 7,042,353 | B2 * | 5/2006 | Stilp | 379/37 |
| 7,079,020 | B2 * | 7/2006 | Stilp | 340/506 |
| 7,079,034 | B2 * | 7/2006 | Stilp | 340/10.34 |
| 7,119,658 | B2 * | 10/2006 | Stilp | 340/551 |
| 2003/0151513 | A1 | 8/2003 | Herrmann et al. | |
| 2003/0152041 | A1 | 8/2003 | Herrmann et al. | |
| 2004/0119585 | A1 | 6/2004 | Farley | |
| 2004/0203343 | A1 | 10/2004 | Schropp et al. | |
| 2004/0212497 | A1 | 10/2004 | Stilp | |
| 2004/0236547 | A1 | 11/2004 | Rappaport et al. | |
| 2005/0276389 | A1 * | 12/2005 | Hinkson et al. | 379/37 |

FOREIGN PATENT DOCUMENTS

EP 1 628 273 A1 2/2006

OTHER PUBLICATIONS

Search Report and Written Opinion for International Application No. PCT/US2006/036161 issued by the European Patent Office on Feb. 5, 2007.

* cited by examiner

*Primary Examiner*—John A Tweel, Jr.
(74) *Attorney, Agent, or Firm*—Baker & Daniels LLP

(57) ABSTRACT

A method of installing a security system includes transmitting an air-borne request signal to a security device. An air-borne reply signal is transmitted from the device in response to the request signal. The reply signal includes identification information corresponding to the device.

31 Claims, 3 Drawing Sheets

METHOD AND APPARATUS FOR ADDING WIRELESS DEVICES TO A SECURITY SYSTEM

BACKGROUND OF THE INVENTION

1. Field of the Invention

The present invention relates to surveillance systems including wireless security devices, and, more particularly, to the installation of surveillance systems including wireless security devices.

2. Description of the Related Art

Surveillance systems, also known as security systems, are known to include wireless security devices, such as wireless motion detectors, wireless door sensors, wireless window sensors, wireless smoke detectors, etc., for monitoring a secured area of space. The wireless devices each transmit a unique identifier, along with any state change or supervisory data, to a receiver within the system. The unique identifiers are used to verify that a transmission from a wireless device actually belongs to and is being received by the intended security system. Thus, each wireless device in use by a security system must be made known to the system by its unique identifier.

It is a goal of the security system manufacturer to make the process of associating a particular wireless device with its unique identifier as simple and as quick as possible for the installer. A traditional approach to establishing a connection within the system between a wireless device and its unique identifier has been to manually enter a series of digits of the unique identifier into a system controller. A human installer places the security system into a special programming mode and enters the unique identifier for each device that is to be used for a particular installation. The installer then typically walks to each wireless device in turn and performs a physical test of each device in order to ensure that the unique identifiers have been entered properly. A problem with this approach is that the process of manually entering each digit of the unique identifier information is time-consuming and subject to installer error.

Another approach to establishing a connection within the system between a wireless device and its unique identifier has been to place the security system into a special programming mode referred to as a "learn mode" of operation. The human installer walks to each wireless device in turn and physically "trips" the wireless device in order to cause the wireless device to transmit a unique identification signal to the system controller. Thereby, the system controller is notified that the currently transmitting device is one that is intended to be used in the system. After all devices have been thus "learned", the installer then typically walks again to each wireless device in turn and performs a physical test of each device in order to ensure that the unique identifiers have been properly received and recorded. A problem with this second approach is that the installer must visit each wireless device twice—first to physically trip the device to learn its identification information, and second to perform the verification test on each of the devices. These two round trips to each of the wireless devices occupy a large amount of the installer's total installation time.

Another problem with both of the above approaches is that the installer must physically visit the structure or area for which the security system is being installed before any of the wireless security devices can be configured and made operational to any degree. Thus, the customer may be forced to wait a considerable period of time for the arrival of the installer after the delivery of additional wireless security devices before the customer can derive any benefit from the additional wireless devices.

What is needed in the art is a wireless security system that can be installed without the installer having to manually enter identification information for wireless devices or having to visit each wireless device in order to cause the wireless device to emit an identification signal and thus be configured into the system.

SUMMARY OF THE INVENTION

The present invention provides a security system including a system controller that transmits air-borne requests for identification information to wireless security devices. The wireless security devices receive the requests and transmit air-borne responses including information uniquely identifying each of the wireless devices. Thus, the wireless devices are installed or configured into the security system.

The invention provides the installer the option of installing a system that is substantially automatically configured. The automatic configuration may be enabled by a discover mode of operation along with some intelligent zone function assignment assumptions by the control panel. For example, all door/window sensors may be assigned a perimeter zone function, all motion detectors may be assigned an interior entry/exit follower zone function, and all smoke detectors may be assigned a fire zone function. Certain installations may require changes to the default assignments. However, for a majority of residential installations, a "one button" installation could be achieved.

The invention comprises, in one form thereof, a method of installing a security system includes transmitting an air-borne request signal to a security device. An air-borne reply signal is transmitted from the device in response to the request signal. The reply signal includes identification information corresponding to the device.

The invention comprises, in another form thereof, a security system including a system controller for transmitting an air-borne request signal. At least one security device receives the request signal and transmits an air-borne reply signal in response to the request signal. The reply signal includes identification information corresponding to the device.

The invention comprises, in yet another form thereof, a method of installing a security system for a structure. An installation initiation signal is remotely transmitted from outside of the structure to a system controller within the structure. An air-borne request signal is transmitted from the system controller to a security device in response to the installation initiation signal. An air-borne reply signal is transmitted from the device in response to the request signal. The reply signal includes identification information corresponding to the device.

An advantage of the present invention is that the wireless security devices may be identified by the system controller without a human installer being required on site to manually activate each of the security devices individually.

Another advantage is that the wireless security devices may be installed more quickly than with known security systems.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
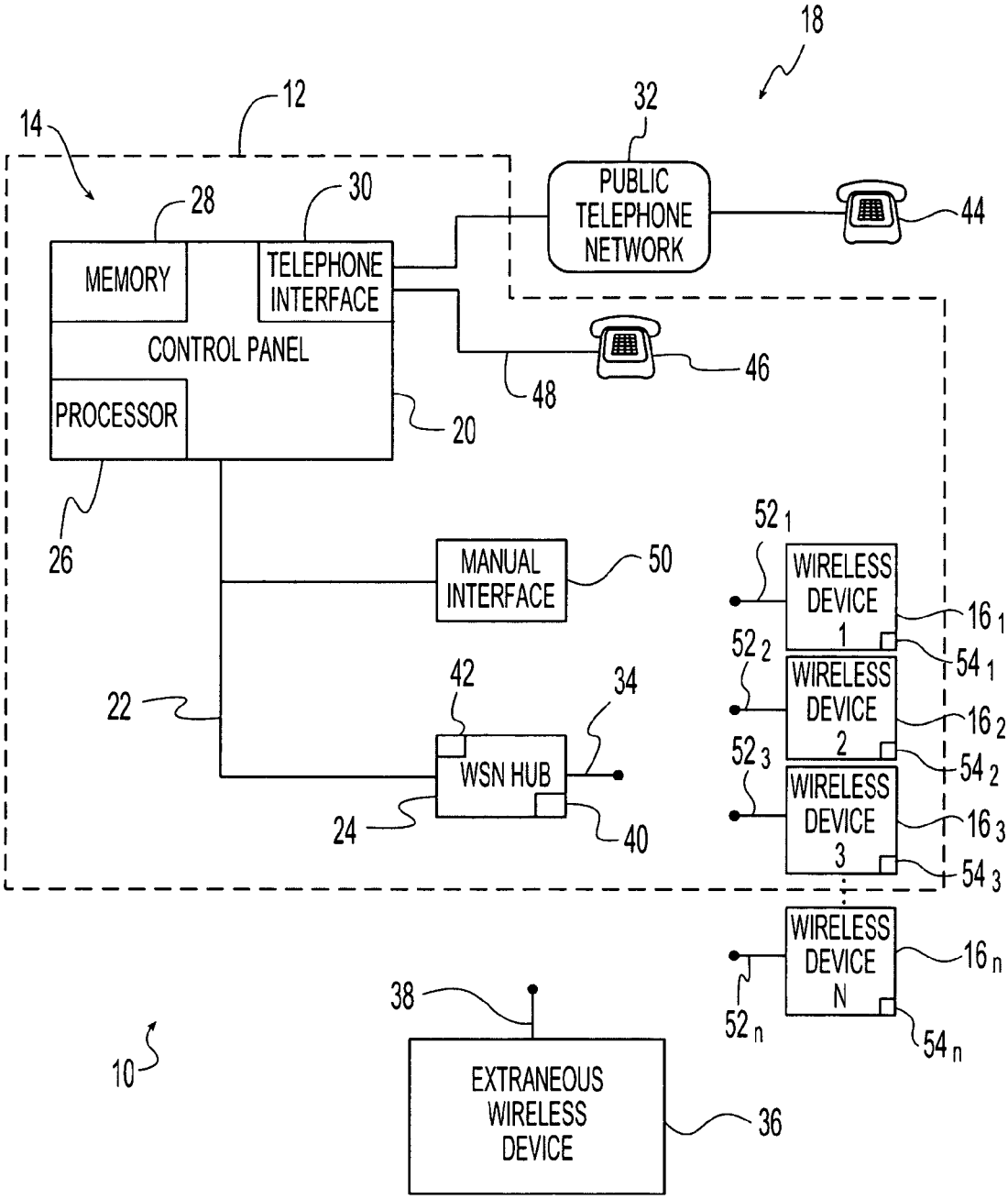
FIG. 1 is a block diagram of one embodiment of a security system of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, wireless security devices $\mathbf{16}_1$, through $\mathbf{16}_n$, and an installer interface 18.

System controller 14 includes a control device in the form of a control panel 20 electrically connected via an option bus 22 to a wireless sensor network (WSN) hub 24. Control panel 20 may include a processor 26, a memory device 28 and a telephone interface 30. Processor 26 may coordinate communication with the various system components including installer interface 18 and WSN hub 24. Memory 28 may include software for interpreting signals from wireless devices 16 and installer interface 18, and deciding based thereon whether to transmit an alarm signal from control panel 20. The alarm signal may be used to activate an audible alarm (not shown) within building 12, or to notify a central station receiver (CSR) (not shown) such as a security company, fire station, or police station, for example, via public telephone network 32. Memory 28 may also store identification information for wireless devices 16, as described in more detail below.

WSN hub 24 may include an antenna element 34 for transmitting and receiving air-borne signals, such as radio frequency signals. The radio frequency signals may be received by and transmitted from, i.e., exchanged with, wireless devices 16 and, in some cases, one or more extraneous wireless devices 36. Extraneous device 36 is not part of system 10, but may be disposed in an adjacent building, for example, such that extraneous device 36 may inadvertently receive air-borne signals from WSN hub 24 and transmit air-borne signals to WSN hub 24 via an antenna element 38. Information from wireless devices 16 may be passed by WSN hub 24 to control panel 20 via option bus 22. Control panel 20 may pass information to WSN hub 24 via option bus 22 for transmission to wireless devices 16 as necessary. WSN hub 24 may include a processor 40 and memory 42 for storing software and identification information from wireless devices 16 and possibly from extraneous devices 36, as described in more detail below.

Installer interface 18 may include an outside communication device 44, such as a cell phone, standard phone, or computer equipped with a modem; a house phone 46, which may be hard-wired to telephone interface 30 via a telephone line 48; and a manual interface 50, which may be in the form of a keypad. Manual interface 50 may be in communication with control panel 20 and WSN hub 24 via option bus 22. Thus, installer interface 18 may be in communication with system controller 14 via public telephone network 32, telephone line 48, and/or option bus 22.

Wireless devices 16 and extraneous device 36 may be in the form of any number or combination of window sensors, door sensors, motion detectors, smoke detectors, panic devices, gas detectors and keyfobs, for example. Window sensors and door sensors may detect the opening and/or closing of a corresponding window or door, respectively. Panic devices may be in the form of devices that human users keep on their person, and that are to be used to summon help in an emergency situation. Gas detectors may sense the presence of a harmful gas such as carbon monoxide, or carbon dioxide. A keyfob may be used to arm or disarm security system 10, and is another device that a user may possibly keep on his person. Each wireless device 16 includes a respective antenna element 52 for transmitting and receiving air-borne signals, such as radio frequency signals. The radio frequency signals may be received by and transmitted from, i.e., exchanged with, WSN hub 24. Wireless devices $\mathbf{16}_1$, $\mathbf{16}_2$ and $\mathbf{16}_3$ are indicated in FIG. 1 as being disposed inside building 12, and wireless device 16, is indicated in FIG. 1 as being disposed outside building 12. However, any number of wireless devices 16 may be disposed within building 12, and any number of wireless devices 16 may be disposed outside building 12. Types of wireless devices that may be permanently or temporarily disposed outside of building 12 during installation may include motion detectors, panic devices and keyfobs.

During installation, some types of wireless devices 16 may be mounted or hung in a permanent or semi-permanent desired location. Examples of such types of wireless devices 16 may include window sensors, door sensors, motion detectors, smoke detectors, and gas detectors. Other types of wireless devices 16 may be disposed in temporary locations during installation, or may even be in motion, such as a panic device or keyfob being carried on a user's person.

To begin the installation, a human installer positioned within building 12 may access installer interface 18 such as by picking up the receiver on house phone 46, or by actuating keys on manual interface 50. As an alternative, or in addition, to house phone 46, there may be a modem-equipped computer (not shown) within building 12 that is attached to telephone line 48 and that may be used as an installer interface. It is also possible for a human installer disposed outside of building 12 to remotely communicate with system 10 by calling a dedicated telephone number associated with security system 10. The calling of the dedicated telephone number may be performed via public telephone network 32 and an outside telecommunication device 44, which is illustrated as a standard telephone in FIG. 1, but may alternatively be in the form of a cell phone or a computer equipped with a modem. The dedicated telephone number associated with security system 10 may be the same number that is used by house phone 46 for voice communication. Regardless of which of outside telecommunication device 44, house phone 46, and manual interface 50 is used, the installer may follow system prompts to thereby cause system 10 to enter a wireless maintenance mode of operation.

Figure 2:
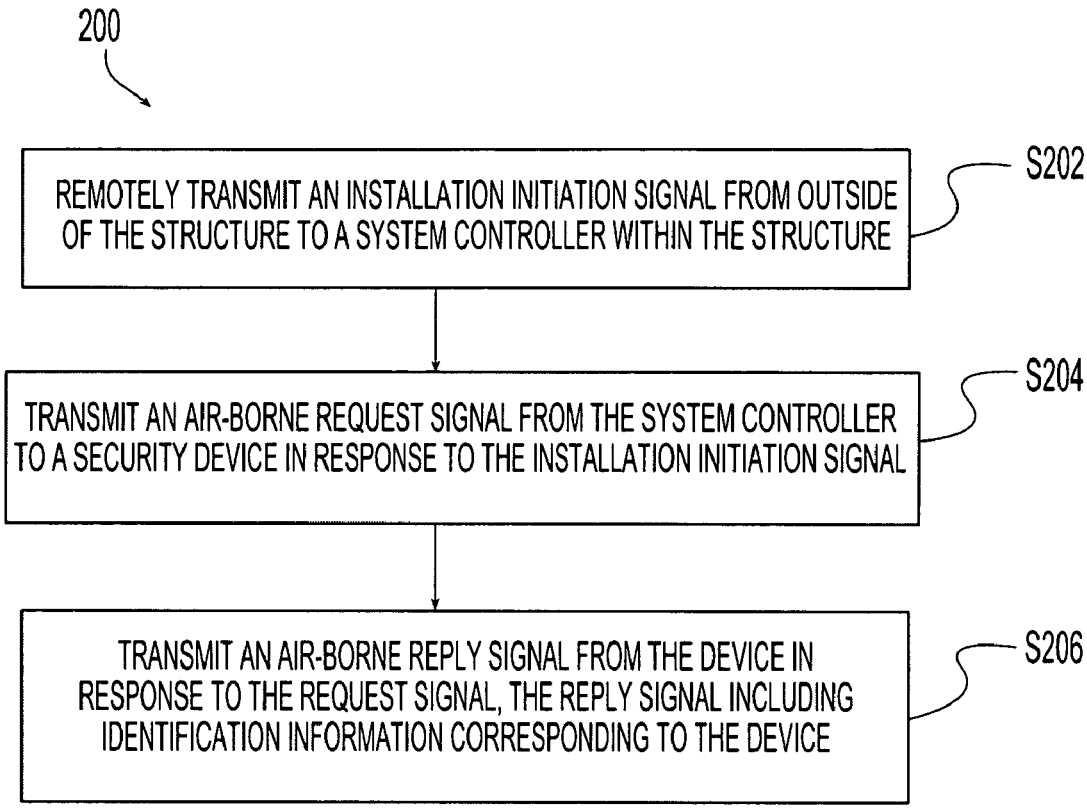
FIG. 2 is a flow chart of one embodiment of a security system installation method of the present invention.

Once the wireless maintenance mode has been entered, the installer may make appropriate selections via installer interface 18 in order to transmit an installation initiation signal directing WSN hub 24 to go into a discover mode. If the user is disposed outside of structure 12, he may remotely transmit the installation initiation signal via a cell phone, for example, as shown in step S202 of method 200 (FIG. 2). In the discover mode, hub 24 may be instructed to "discover" wireless devices, such as wireless devices 16, that need to be installed in system 10. Discovering a wireless device may include receiving or otherwise ascertaining unique identification information for that device, such as an identification number, a type of the device, and/or a function of the device.

The identification number may be any string of alphanumeric characters and/or bits that uniquely identifies the wireless device with which the identification information is associated. This identification number may be included within any signal transmitted from a wireless device, both during installation and during surveillance operation of system 10, in order to identify which of wireless devices 16 that the signal is being transmitted from.

The device type information may specify whether the wireless device is a window sensor, door sensor, motion detector, smoke detector, gas detector, panic device or keyfob, for example. The device type information may further break down these categories by subcategories such as indoor or outdoor motion detector, garage door or front door sensor, carbon monoxide or carbon dioxide, etc.

The function information may include the conditions under which control panel 20 should transmit an alarm signal, or take some other action, in response to the wireless device transmitting a notification signal during surveillance operation. The notification signal from the wireless device may indicate, in the case of a panic device or keyfob, that a button on the panic device or keyfob is being actuated, or may indicate that the wireless device is sensing motion, smoke, gas, the opening of a door/window, etc. For example, if a door sensor is on a door that can be unlocked from outside building 12 with a key, then it may be desirable to transmit an alarm signal only under the condition that an arm/disarm code has not been entered on manual interface 50 within one minute after the door is opened. Thus, a resident of building 12 returning from a trip would have a chance to disarm system 10 after unlocking the door. Conversely, if a door sensor is on a door that cannot be unlocked from outside building 12 with a key, then it may be desirable to transmit an alarm signal under all conditions in which system 10 is armed and the door has been opened. Other examples of the various functions of security devices are known in the art, and thus are not discussed in further detail herein.

Figure 3:
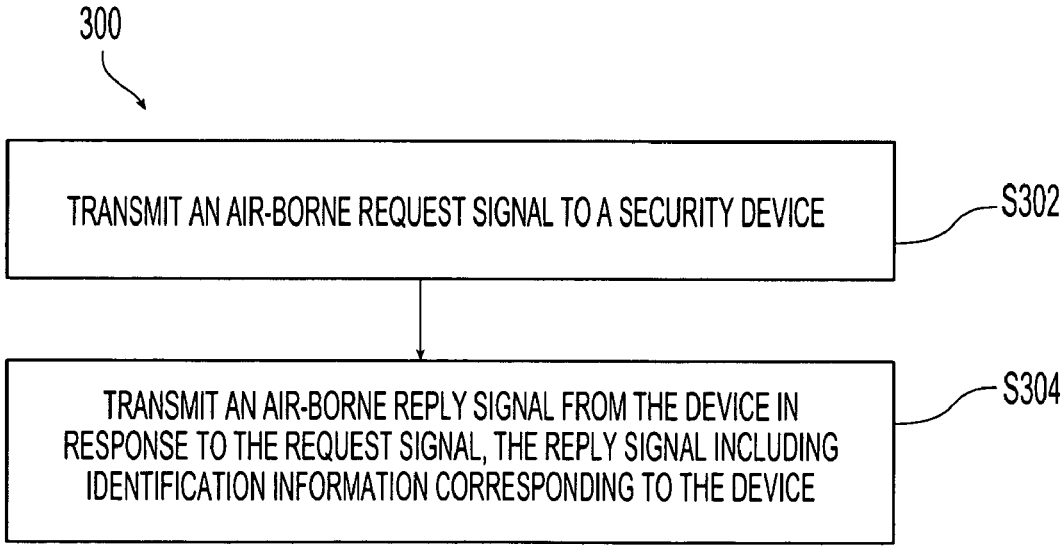
FIG. 3 is a flow chart of another embodiment of a security system installation method of the present invention.
Figure 4:
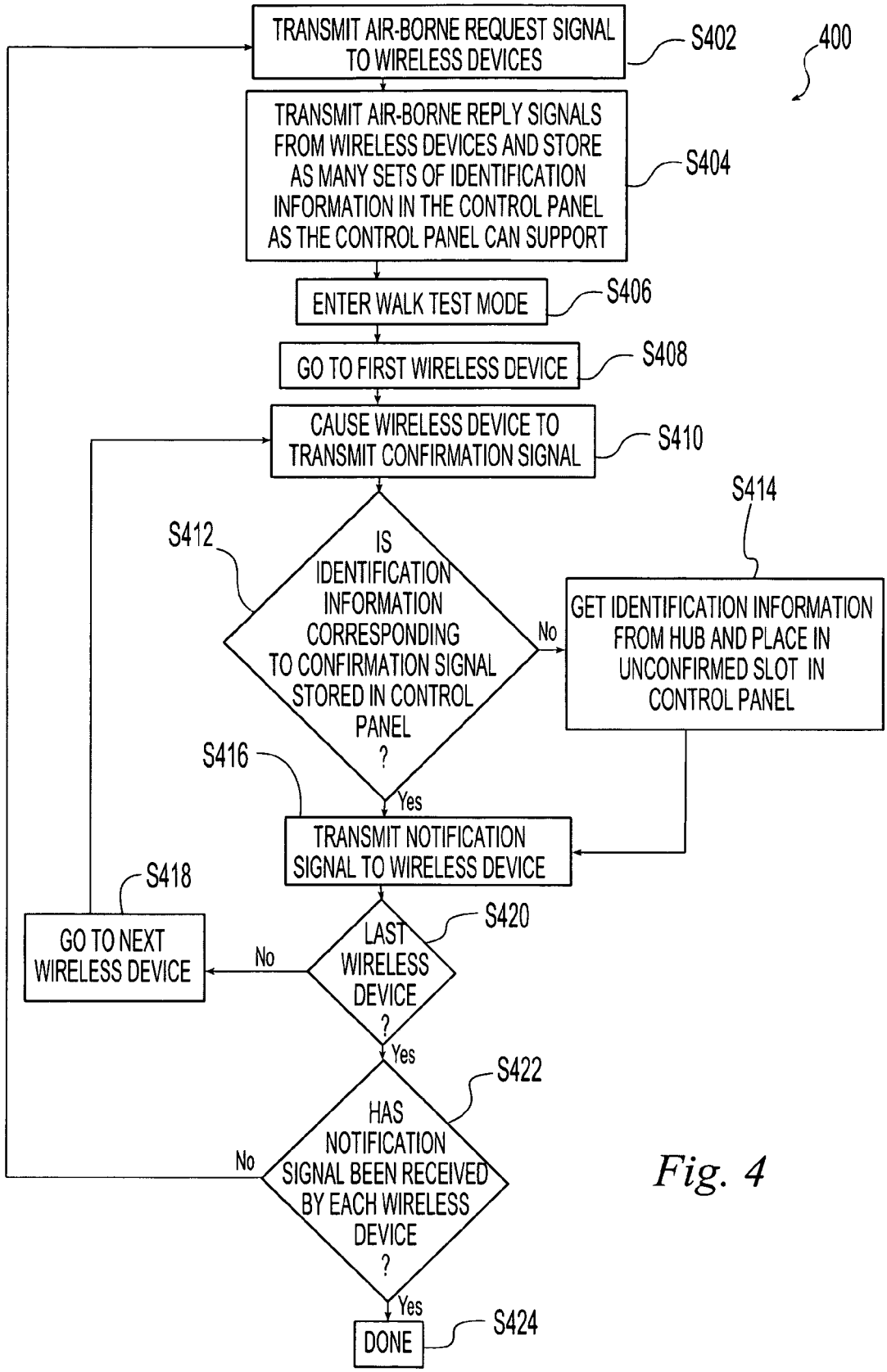
FIG. 4 is a flow chart of yet another embodiment of a security system installation method of the present invention.

When system 10 is in the discover mode, in response to the installation initiation signal, hub 24 may transmit, i.e., broadcast, a message in the form of an air-borne request signal that instructs all wireless devices that receive the request signal to respond with their unique identifier, as in step S204 of method 200, step S302 of method 300 (FIG. 3), and step S402 of method 400 (FIG. 4). When a wireless device receives the broadcast message, the wireless device may respond with its unique identifier. That is, in response to the request signal, each wireless device 16 may transmit a respective air-borne reply signal including identification information corresponding to that wireless device, as in steps S206, S304, and S404.

In addition to the reply signals from wireless devices 16, hub 24 may receive an identification signal from one or more extraneous wireless device 36 which may be included in the security systems of adjacent buildings, or which may be other types of wireless devices that follow an identification protocol that is similar to that of system 10. The information received from extraneous wireless devices 36 may or may not be in response to the request signal from hub 24, and thus the identification signals received by hub 24 from extraneous wireless devices 36 may or may not be reply signals. Hub 24 may retain the unique identifiers for all devices, including extraneous devices 36, that respond to the request signal during the discovery phase, or that may transmit an identification signal without prompting. That is, hub 24 may receive and store a respective reply signal including nonextraneous identification information from each of wireless devices 16. Hub 24 may also receive and store a respective extraneous identification signal including extraneous identification information from each of extraneous wireless devices 36.

Following the discovery phase, hub 24 may give control panel 20 the identification information from all wireless devices 16 that transmit a reply signal in response to the request signal. The newly discovered wireless devices may be assigned the next available panel zone numbers. The installer may proceed to the walk test phase where the new devices can be verified.

Once the discover phase is complete, and control panel 20 has received its full capacity of identification information, the identification information may be sorted and zone numbers may be assigned by control panel 20. Zone numbers may be assigned based on groups of wireless device types. For example, all the window sensors that respond may be assigned consecutive zone numbers beginning with the first available zone number that is available. Control panel 20 may then assign zone numbers to the motion detectors, picking up where the assignment of zone numbers to the window sensors left off. Next, zone numbers may be assigned to smoke detectors, and so on until all devices that responded are assigned a zone number.

Once the assignment process has been completed, the installer may perform a walk test (step S406) in which the installer walks to each of wireless devices 16 in sequence and causes each wireless device 16 to transmit a respective confirmation signal including the nonextraneous identification information to hub 24. The walk test may be used to ensure that all wireless devices 16 have been discovered by system 10. When control panel 20 begins the walk test, a message may be sent from control panel 20 to hub 24 and in turn to each wireless device 16 to indicate that system 10 is in the walk test mode.

The installer may then proceed to a first wireless device 16 (step S408) and activate the wireless device in some fashion, such as by pressing a button on the wireless device, to thereby cause the wireless device to transmit a confirmation signal (step S410). Via the installer interface, which may be a cellular phone or wireless phone that the installer carries with him, the installer may be notified of the zone number for the wireless device that is currently being tested, i.e., that is currently or has most recently transmitted a confirmation signal.

The confirmation signal may include the same nonextraneous identification information that the wireless device transmitted in the reply signal. Thus, system 10 may recognize nonextraneous identification information as identification information received by hub 24 in both the reply signals and the confirmation signals.

System 10 may occasionally receive reply signals from, or otherwise detect, a device that is not intended for installation, such as an extraneous wireless device 36. Any identification information from any wireless device that is not confirmed during the walk test may be discarded. As system 10 is walk tested, if control panel 20 does not have identification information corresponding to a wireless device from which a confirmation signal has been received (step S412), then control panel 20 may query hub 24 for the new identification information from the wireless device. The new identification information may be placed in the first available unconfirmed slot in memory 28 of control panel 20 (step S414). Thus, any extraneous identification information originating from any extraneous device 36 and disposed in an unconfirmed slot may be overwritten with at least portions of the nonextraneous identification information which may be stored in hub 24. If, at step S414, the identification information corresponding to a wireless device from which a confirmation signal has been received is determined to not be stored in either hub 24 or control panel 20, then operation may be returned to step S402 so that the discover phase may be repeated. This procedure may be similar to the procedure for adding a new wireless device to an existing installed system 10.

As each wireless device 16 is walk tested, system 10 may immediately determine the signal-to-noise ratio of the reply signal received by hub 24 from the wireless device. If the signal strength, e.g., the signal-to-noise ratio, is within acceptable limits, then the installer may be prompted via installer interface 18 to accept or reassign the wireless device. If the signal-to-noise ratio is below an acceptable level, then the installer may be notified that the wireless device needs to be relocated.

At this point, system 10 may prompt the installer to accept the assigned zone number or select a new zone number. If an entered zone number is not in use, then the wireless device may be assigned to the selected zone number. If the selected zone number is in use, then the device currently occupying that zone number may be replaced with the zone number of the device currently being tested. The device currently being tested may be assigned the selected zone number.

Each wireless device 16 may be provided with an LED 54 that may light up or flash to indicate to the installer that the wireless device is transmitting, or has recently transmitted, a confirmation signal. After receiving the confirmation signal, hub 24 may transmit an air-borne notification signal to the wireless device 16 that transmitted the confirmation signal (step S416). In response to receiving the notification signal, the wireless device 16 that transmitted the confirmation signal may cause its LED to light up or flash in a distinctive pattern to thereby confirm to the installer that system 10 is working with the desired wireless device. In one embodiment, LED 54 may turn on and remain on when transmitting a confirmation signal, and may flash on and off in response to receiving a notification signal from the hub.

If the LED does not light up or flash at the desired device, then the installer may need to perform some troubleshooting. For example, the installer may check the battery (not shown) of the wireless device or replace the wireless device with another one.

After the wireless device has received a notification signal, or perhaps has been troubleshot by the installer, the installer moves on to the next wireless device 16 (step S418) and causes this new wireless device to transmit a confirmation signal (step S410). After it is checked and ensured that the identification information of the wireless device is stored in the control panel (steps S412, S414), a notification signal may be sent to the wireless device (step S416). The process repeats for each subsequent wireless device until the last wireless device 16 has been walk tested (step S420). If a notification signal has been received by each wireless device 16 (step S422), then installation may be complete (step S424). However, if there are any wireless devices 16 that have not received a notification signal, then operation may return to step S402 so that the discovery process may be repeated.

There may be an occasion when a wireless device 16 is no longer needed and should be removed from the system. In order to remove a wireless device 16 from system 10, the installer may remove the batteries from the wireless device. Next, hub 24 may broadcast a message to all of wireless devices 16. Having its batteries removed, the uninstalled wireless device 16 will not be able to reply. Any wireless device that does not reply may thus become a candidate for being deleted from system 10 and may be identified to the installer. The installer may then confirm the deletion/removal of the wireless device(s) to thereby complete the removal process.

There may also be an occasion when a wireless device 16 needs to be replaced by another wireless device 16. The replacement may begin with the deletion, as described above, of the wireless device that is to be taken out of service. Hub 24 may broadcast a message and the wireless device that does not reply may be identified as a node that may be replaced. The new replacement wireless device may be installed at this point. Hub 24 may then issue a discover message in the form of a request signal. The new wireless device may respond with a reply signal and thus take the place of the deleted wireless device.

In the above-described device replacement process, system 10 may automatically replace a wireless device with a wireless device of the same type. For example, if a faulty door sensor is replaced with a new door sensor, system 10 may have a unique identifier for a zone, and the type, i.e., door sensor, may be known. System 10 may identify a new wireless device during the discover phase and may also recognize that the previously known wireless device has been removed. Now, determining that the old device type matches the device type of a new wireless device, the new device may take the place of the removed device.

Adding a mobile device, such as a keyfob, may occur as part of a user maintenance task. On a wireless enabled system, the user may be prompted to add a keyfob to a user as part of an "add user" procedure. When the user is prompted, a particular key sequence may be initiated from the keyfob. When hub 24 receives a particular air-borne signal as a result of the particular key sequence, the keyfob identification information including its device type may be sent to control panel 20. Control panel 20 may then send the user number to hub 24. This process may tie the keyfob to the desired user number.

Resetting wireless devices 16 and hub 24 to a factory default condition may be accomplished via hardware by removing the batteries, depressing the tamper switch and then replacing the batteries.

As an alternative to the discovery mode of system 10, the installer may have the option of manually entering radio frequency identification (RFID) information. This may only be available via an expert-programming mode using a telephone. Programming addresses may be provided that allow the entry of the necessary RFID information. The discovery phase may still need to be executed in order to find the desired devices. Following discovery, the walk test mode may occur.

While this invention has been described as having an exemplary design, the present invention may be further modified within the spirit and scope of this disclosure. This application is therefore intended to cover any variations, uses, or adaptations of the invention using its general principles.

What is claimed is:

1. A method of installing a security system, said method comprising the steps of:

mounting a plurality of security devices at a plurality of desired locations within a structure;

transmitting an air-borne request signal to the plurality of security devices;

transmitting an air-borne reply signal from each said device in response to the request signal, the reply signal including identification information corresponding to said device;

causing each of said security devices to transmit a respective confirmation signal; and recognizing identification information as identification information received in both the reply signals and the confirmation signals.

2. The method of claim 1 wherein the request signal is transmitted from a system controller, and the reply signals are transmitted to said system controller.

3. The method of claim 2 wherein said system controller comprises a control device and a hub, said hub receiving a respective said reply signal including nonextraneous identification information from each of said security devices and at least one extraneous identification signal including extraneous identification information from at least one extraneous device, said method comprising the further steps of:

storing the nonextraneous identification information and the extraneous identification information in said hub; and transferring from said hub to said control device only an amount of the identification information that corresponds to a number of said security devices that said control device is capable of supporting.

4. The method of claim 3 wherein the causing step causes each of said security devices to transmit a respective confirmation signal including the nonextraneous identification information to said hub; and the recognizing step recognizes nonextraneous identification information as identification information received by said hub in both the reply signals and the confirmation signals; and further comprising overwriting any of the extraneous identification information that is in said control device with at least portions of the nonextraneous information from said hub.

5. The method of claim 1 wherein the identification information designates said device as at least one of a window sensor, a door sensor, a motion detector, a smoke detector, a panic device, a gas detector and a keyfob.

6. The method of claim 1 wherein the identification information designates a function of said device.

7. The method of claim 1 comprising the further step of accessing an installer interface to thereby initiate said step of transmitting the request signal.

8. The method of claim 7 wherein said installer interface comprises a telephone.

9. A security system comprising:

a system controller configured to transmit an air-borne request signal; and a plurality of security devices configured to receive the request signal and transmit an air-borne reply signal in response to the request signal, the reply signal being received by the controller and including identification information corresponding to said device, and wherein said system controller comprises a control device and a hub, said hub being configured to:

receive a respective said reply signal including nonextraneous identification information from each of said security devices and at least one extraneous identification signal including extraneous identification information from at least one extraneous device;

store the nonextraneous identification information and the extraneous identification information; and transfer from said hub to said control device only an amount of the identification information that corresponds to a number of said security devices that said control device is capable of supporting.

10. The system of claim 9 wherein each of said security devices is configured to transmit a respective confirmation signal including the nonextraneous identification information to said hub, said system controller being configured to recognize the nonextraneous identification information as identification information that is received by said hub in both the reply signals and the confirmation signals.

11. The system of claim 9 wherein said control panel includes a telephone interface.

12. The system of claim 9 wherein said plurality of security devices comprise at least one of a window sensor, a door sensor, a motion detector, a smoke detector, a panic device, a gas detector and a keyfob.

13. The system of claim 9 further comprising an installer interface in communication with said system controller.

14. A method of installing a security system for a structure, said method comprising the steps of:

remotely transmitting an installation initiation signal from outside of the structure to a system controller within the structure;

transmitting an air-borne request signal from said system controller to a security device in response to the installation initiation signal; and transmitting an air-borne reply signal from said device in response to the request signal, the reply signal including identification information corresponding to said device.

15. The method of claim 14 wherein the installation initiation signal is remotely transmitted to said system controller via a telephone.

16. The method of claim 14 wherein the reply signal is transmitted to said system controller.

17. The method of claim 16 wherein said system controller comprises a control device and a hub, the request signal being transmitted to a plurality of security devices, said hub receiving a respective said reply signal including nonextraneous identification information from each of said security devices and at least one extraneous identification signal including extraneous identification information from at least one extraneous device, said method comprising the further steps of:

storing the nonextraneous identification information and the extraneous identification information in said hub; and transferring from said hub to said control device only an amount of the identification information that corresponds to a number of said security devices that said control device is capable of supporting.

18. The method of claim 17 comprising the further steps of:

causing each of said security devices to transmit a respective confirmation signal including the nonextraneous identification information to said hub;

recognizing nonextraneous identification information as identification information received by said hub in both the reply signals and the confirmation signals; and overwriting any of the extraneous identification information that is in said control device with at least portions of the nonextraneous information from said hub.

19. The method of claim 14 comprising the further step of mounting said device at a desired location before said transmitting steps.

20. The method of claim 14 wherein the identification information designates said device as at least one of a window sensor, a door sensor, a motion detector, a smoke detector, a panic device, a gas detector and a keyfob.

21. The method of claim 14 wherein the identification information designates a function of said device.

22. The method of claim 1, further comprising determining a strength of a signal transmitted by a particular security device and sending a notification to an installer based on the determining step.

23. The method of claim 22, wherein the notification notifies the installer that the particular security device needs to be relocated if the signal strength is below an acceptable level.

24. The method of claim 22, wherein the notification prompts the installer to accept the particular security device if the signal strength is at or above an acceptable level.

25. The method of claim 1, further comprising assigning zones to the plurality of security devices.

26. The method of claim 1, wherein the step of transmitting an airborne reply signal from said plurality of security devices in response to the request signal occurs without an installer being present at the location of the plurality of security devices.

27. The method of claim 26, wherein the step of causing each of said security devices to transmit a respective confirmation signal is performed by an installer at the mounting locations of the plurality of sensors.

28. The method of claim 27, wherein the plurality of security devices include an indicator to provide an indication to the installer that the security device has transmitted the confirmation signal.

29. The method of claim 1, further comprising transmitting a notification signal to a particular security device after the recognizing step, receiving the notification signal at the particular security device, and providing an indication to an installer that the system is working with the particular security device.

30. The method of claim 1, further comprising the step of removing a security device from the system, the removing step comprising disabling the security device, transmitting second airborne request signal to the plurality of security devices, and confirming removal of the security devices which did not transmit the airborne reply signal in response to the second airborne request signal.

31. The method of claim 30, further comprising the step of replacing the removed security device with a new security device, determining that a device type of the new device matches a device type of the removed device, and replacing the removed device with the new device by storing received identification information from the new device.

* * * * *